US005524895A

United States Patent [19]

Nakajima

[11] Patent Number: 5,524,895

[45] Date of Patent: Jun. 11, 1996

[54] PRACTICE GOLF CLUB PUTTER

[76] Inventor: Atsushi Nakajima, Grosvenor Center, PRI/Makai Tower, 733 Bishop St.; Suite 1770, Honolulu, Hi. 96813

[21] Appl. No.: 374,971

[22] Filed: Jan. 19, 1995

[51] Int. Cl.[6] ..... A63B 53/00; A63B 69/36

[52] U.S. Cl. ..... 473/249; 473/306

[58] Field of Search ..... 273/194 RA, 175, 273/167 C, 186.2, 164.2

[56] References Cited

U.S. PATENT DOCUMENTS

| | | | |
|---|---|---|---|
| 2,388,463 | 11/1945 | Benecke | 273/186.2 |
| 3,700,244 | 10/1972 | Liotta | 273/186.2 |
| 3,759,527 | 9/1973 | Witherspoon | 273/175 X |
| 4,111,426 | 9/1978 | Goodwin | 273/167 CX |
| 4,688,798 | 8/1987 | Pelz | 273/164.2 |
| 5,135,228 | 8/1992 | Hawkins, Sr. et al. | 273/186.2 |
| 5,207,721 | 5/1993 | Lobdell | 273/186.2 |
| 5,240,253 | 8/1993 | Cooper | 273/186.2 |

OTHER PUBLICATIONS

*Popular Mechanics,* vol. 128, No. 3, pp. 83. Sep. 1967.

*Primary Examiner*—William H. Grieb
*Attorney, Agent, or Firm*—Michael I. Kroll

[57] ABSTRACT

A practice golf club putter comprising a grip to be held by the hands of a golfer. An elongated shaft extends from the grip. A putter head is provided having a convex striking surface. A facility is for securing a lower end of the shaft to the putter head. The convex striking surface of the putter head can stroke a golf ball, to make the golf ball roll in a straight line upon a putting green.

4 Claims, 2 Drawing Sheets

Fig. 3
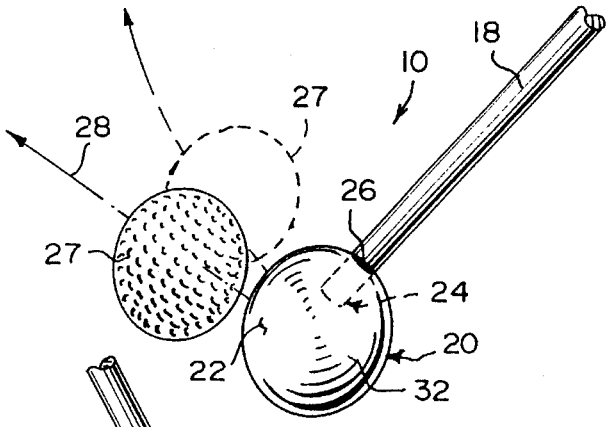
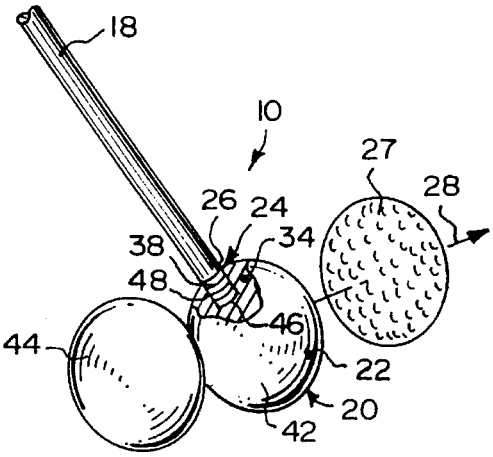
Fig. 4
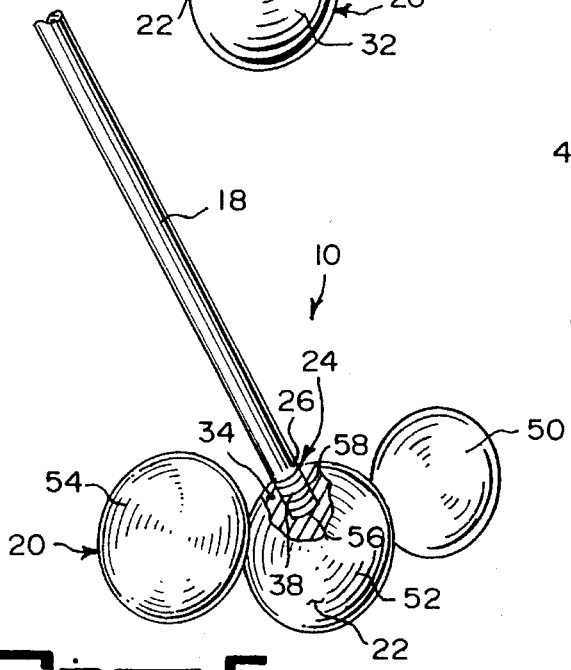
Fig. 5

PRACTICE GOLF CLUB PUTTER

BACKGROUND OF THE INVENTION

1. Field of the Invention

The instant invention relates generally to golf equipment and more specifically it relates to a practice golf club putter.

2. Description of the Prior Art

Numerous golf equipment have been provided in prior art that are adapted to be utilized by golfers to enhance their ability to strike golf balls. For example, U.S. Pat. Nos. 3,700,244 to Liotta; 5,207,721 to Oobdell; 5,240,253 to Cooper and 5,135,228 to Hawkins, Sr. et al. all are illustrative of such prior art. While these units may be suitable for the particular purpose to which they address, they would not be as suitable for the purposes of the present invention as heretofore described.

LIOTTA, ALFONSO L.

GOLF PUTTER INCLUDING SPHERICAL HEAD WITH MIRROR REFLECTING SURFACE

U.S. Pat. No. 3,700,244

A putter for use to improve skill in putting a golf ball is provided with a ball engaging head which presents a spherical face to engage the ball. This face has a reflecting mirror surface in which the user of the putter can see the image of a ball while he grasps the putter handle. within the reflecting area, and positioned in the area of the reflecting surface visible to the user grasping the putter, there is an indicator mark contrasting with the mirror surface so as to be readily visible.

HAWKINS SR., ARNOLD R.

HAWKINS JR., ARNOLD R.

PRACTICE ATTACHMENT FOR GOLF CLUBS

This invention discloses a system for improving ones golf game by using a practice club with a very small head to hit practice balls that are light weight and preferably are very small in diameter. The novel practice golf club has a head or ball-hitting surface which is much smaller than a conventional golf club, such as either surface having a width of about 3.5 cm (1.4 in.) or less or even about 1.5 cm (0.6 in.) or less or a convex surface having a radium of less than about 1.25 cm (0.5 in.) or even about 0.8 cm. (0.3 inc.) or less. The practice balls are much lighter and preferably smaller than a conventional golf ball, such as less than about 30 g. for example about 1.9 cm (0.75 inc.) in diameter and about 1.5 g. or about 1.27 cm (0.5 in.) in diameter and about 1 g. This invention includes as optical components of the system mat means and net means. The invention can be embodied in the form of an adaptor to convert a conventional golf club to have the type of ball-hitting surface described above.

LOBDELL, THOMAS

PUTTER

U.S. Pat. No. 5,207,721

A golf putter includes an elongated head having an axle adapted for supporting a pair of coaxial rotatable wheels. The putter is rolled along the wheels in the direction of a sight line to strike and direct the golf ball. The strike surface of the putter is convex to assure proper relative position between the ball and the strike surface regardless of the angular position of the putter. The wheels have a resilient outer covering to protect the putting surface and to assure that the wheels grip the putting surface and roll rather than slide as the putter is advanced.

COOPER, GENE E.

PRACTICE AID GOLF CLUB PUTTER

U.S. Pat. No. 5,240,253

A golf club putter includes an elongated cylindrical extension removably secured to project forwardly along the club head center line and providing a cue stick-like tip for learning to strike a ball squarely during practice. For play, the extension is either relocated along the center line behind the club face, or replaced by an insert, to maintain the club weight constant for play.

SUMMARY OF THE INVENTION

A primary object of the present invention is to provide a practice golf club putter that will overcome the shortcomings of the prior art devices.

Another object is to provide a practice golf club putter that is intended only for practice and training, to improve a golfers putting skills.

An additional object is to provide a practice golf club putter that will force a golfer to strike a golf ball squarely with a rounded putter head in order for the golf ball to roll in a straight line.

A further object is to provide a practice golf club putter that is simple and easy to use.

A still further object is to provide a practice golf club putter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 3 is an enlarged perspective view of the putter head as indicated by arrow 3 in FIG. 1, striking a golf ball.

FIG. 4 is an enlarged perspective view of a putter head of a second embodiment of the instant invention striking a golf ball.

FIG. 5 is an enlarged perspective view of a putter head of a third embodiment of the instant invention.

Similar reference characters denote corresponding features consistently throughout the attached drawings.

DETAILED DESCRIPTION OF THE PREFERRED EMBODIMENTS

Figure 1:
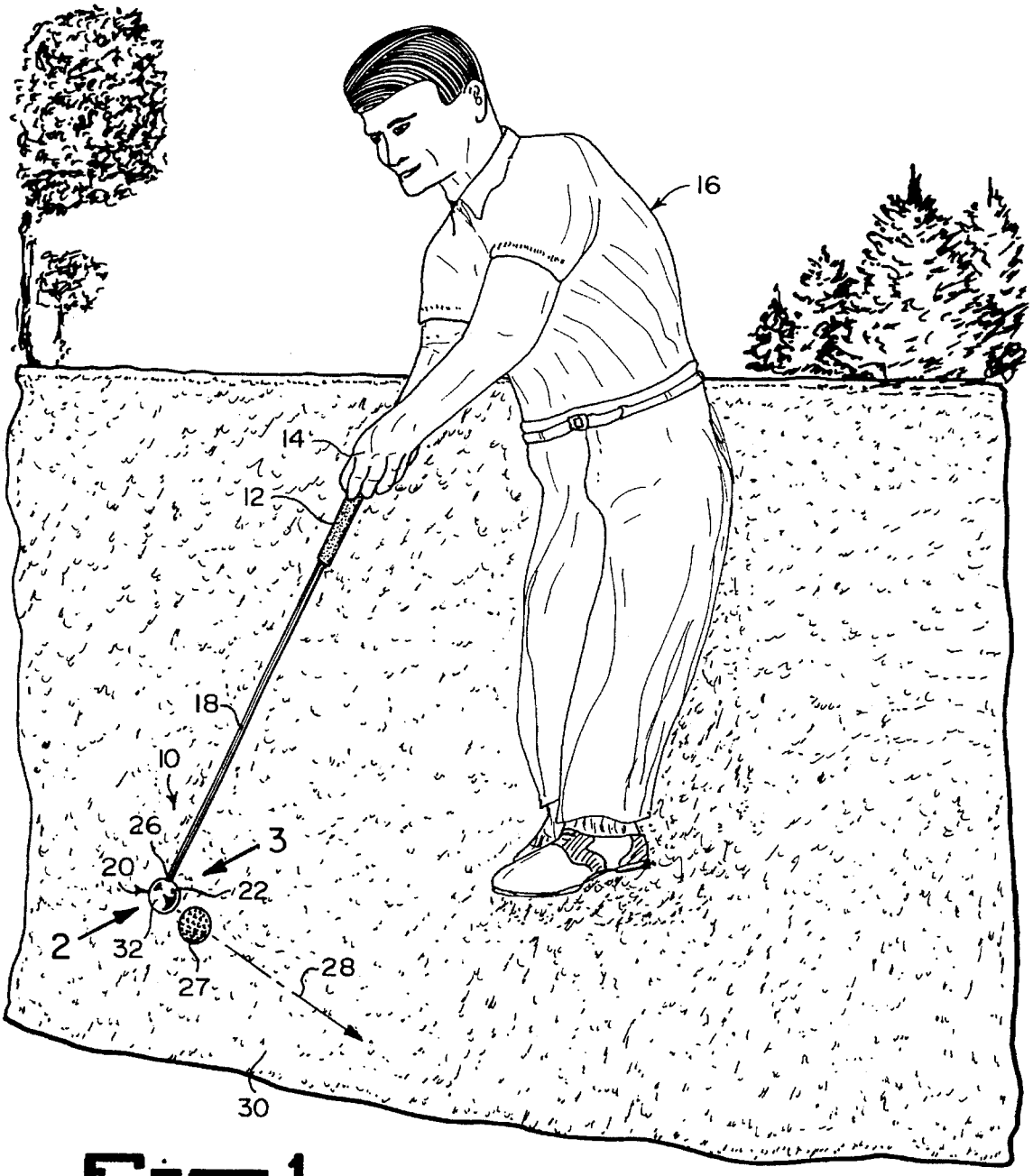
FIG. 1 is a perspective view of a first embodiment of the instant invention being used by a golfer.
Figure 2:
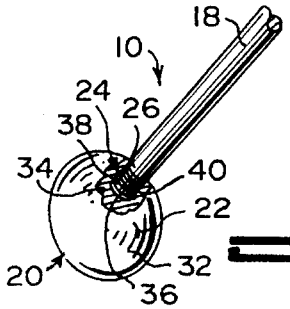
FIG. 2 is an enlarged perspective view of the putter head as indicated by arrow 2 in FIG. 1, with parts broken away and in section.

Turning now descriptively to the drawings, in which similar reference characters denote similar elements throughout the several views, FIGS. 1 through 3 illustrate a practice golf club putter 10 comprising a grip 12 to be held by the hands 14 of a golfer 16. An elongated shaft 18 extends from the grip 12. a putter head 20 is provided, having a convex striking surface 22. A facility 24 is for securing a lower end 26 of the shaft 18 to the putter head 20. The convex striking surface 22 of the putter head 20 can stroke a golf ball 27, to make the golf ball 27 roll in a straight line 28 upon a putting green 30.

The putter head 20 is a spherical body 32. The spherical body 32 is fabricated out of a metal material 34. The securing facility 24 includes the spherical body 32 having a socket 36, to receive and retain the lower end 26 of the shaft 18 therein.

The lower end 26 of the shaft 18 has external threads 38. The socket 36 in the spherical body 32 has internal threads 40. The lower end 26 of the shaft 18 can be threaded into the socket 36 and be better retained in place to the spherical body 32.

In FIG. 4, the putter head 20 is two spherical bodies 42 and 44 affixed to each other in a straight position side by side relationship. The spherical bodies 42 and 44 are fabricated out of a metal material 34. The securing facility 24 consists of the first spherical body 42 having a top socket 46, to receive and retain the lower end 26 of the shaft 18 therein.

The lower end 26 of the shaft has external threads 38. The top socket 46 in the first spherical body has internal threads 48. The lower end 26 of the shaft 18 can be threaded into the top socket 46 and be better retained in place to the first spherical body 42.

The putter head 20 in FIG. 5, is three spherical bodies 50, 52 and 54 affixed to each other in a V-position side by side relationship. The spherical bodies 50, 52 and 54 are fabricated out of a metal material 34. The securing facility 24 consists of the second spherical body 52 having a top socket 56, to receive and retain the lower end 26 of the shaft 18 therein.

The lower end 26 of the shaft 18 has external threads 38. The top socket 56 in the second spherical body 52 has internal threads 58. The lower end 26 of the shaft 18 can be threaded into the top socket 56 and be better retained in place to the second spherical body 52.

OPERATION OF THE INVENTION

To use the practice golf club putter 10, the following steps should be taken:

1. Attach the putter head 20 to the lower end 26 of the shaft 18 by the securing facility 24.
2. Grasp the grip 12 by the hands 14.
3. Position the putter head 20 adjacent the golf ball 27 on the putting green 30.
4. Pivot the grip 12 rearwardly so that the putter head 20 moves away from the golf ball 27.
5. Swing the grip 12 forwardly until the putter head 20 strikes the golf ball 27 on the convex striking surface 22, so that the golf ball 27 will travel in a straight line 28 on the putting green 30.

LIST OF REFERENCE NUMBERS

10 practice golf club putter
12 grip of 10
14 hand of 16
16 golfer
18 elongated shaft of 10
20 putter head
22 convex striking surface of 20
24 securing facility
26 lower end of 18
27 golf ball
28 straight line on 30
30 putting green
32 spherical body for 20
34 metal material of 32
36 socket in 32
38 external threads on 26
40 internal threads in 36
42 first spherical body of 20
44 second spherical body of 20
46 top socket in 42
48 internal threads in 46
50 first spherical body of 20
52 second spherical body of 20
54 third spherical body of 20
56 top socket in 52
58 internal threads in 56

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A practice golf club putter comprising:

a) a grip to be held by the hands of a golfer;

b) an elongated shaft extending from said grip;

c) a putter head having a convex striking surface, said putter head being three spherical bodies affixed to each other in a V-position side by side relationship; and d) means for securing a lower end of said shaft to said putter head, so that said convex striking surface of said putter head strokes a golf ball to make the golf ball roll in a straight line upon a putting green.

2. A practice golf club putter as recited in claim 1, wherein said spherical bodies are fabricated out of a metal material.

3. A practice golf club putter as recited in claim 2, wherein said securing means includes said second spherical body having a top socket to receive and retain said lower end of said shaft therein.

4. A practice golf club putter as recited in claim 3, wherein said securing means further includes:

a) said lower end of said shaft having external threads; and b) said top socket in said second spherical body having internal threads, so that said lower end of said shaft can be threaded into said top socket and be better retained in place to said second spherical body.

* * * * *